United States Patent [19]

Oda

[11] 4,391,022

[45] Jul. 5, 1983

[54] AUTOMATIC LOCK SLIDER FOR SLIDE FASTENERS

[75] Inventor: Kiyoshi Oda, Namerikawa, Japan

[73] Assignee: Yoshida Kogyo K. K., Tokyo, Japan

[21] Appl. No.: 239,573

[22] Filed: Mar. 2, 1981

[30] Foreign Application Priority Data

Mar. 4, 1980 [JP] Japan ..... 55-28108[U]
Mar. 4, 1980 [JP] Japan ..... 55-28109[U]

[51] Int. Cl.[3] ..... A44B 19/00
[52] U.S. Cl. ..... 24/205.14 R
[58] Field of Search ..... 24/205.14 R, 205.15 R

[56] References Cited

U.S. PATENT DOCUMENTS

| | | | |
|---|---|---|---|
| 2,549,380 | 4/1951 | Marinsky | 24/205.14 R |
| 2,946,109 | 7/1960 | Bashover | 24/205.14 R |
| 4,069,556 | 1/1978 | Takshashi | 24/204.14 |
| 4,139,928 | 2/1979 | Aoki et al. | 24/205.14 R |

FOREIGN PATENT DOCUMENTS

| | | | |
|---|---|---|---|
| 523277 | 3/1956 | Canada | 24/205 |

*Primary Examiner*—Gene Mancene
*Assistant Examiner*—Wenceslao J. Contreras
*Attorney, Agent, or Firm*—Hill, Van Santen, Steadman, Chiara & Simpson

[57] ABSTRACT

An automatically locking slider for slide fasteners has a locking member including a piece of resilient strip, preferably made of stainless steel, which is bent into a generally "3" shape having a U-shaped base extending around a transverse spindle of a pull tab, a locking prong extending from one end of the base, and an anchor extending from the other end of the base and terminating in a hook-shaped end hooked with a locking-member retaining nose on a slider's neck. The base is normally urged against the spindle of the pull tab by the resilience of the strip. The hook-shaped end of the anchor is normally urged against the nose by the resilience of the strip and is thereby prevented from being unhooked from the nose. Thus the locking member is held in position on a slider body solely by the resilience of the strip, requiring no bending or deforming of any part of the slider body that would make the slider defective from an aesthetic view.

8 Claims, 9 Drawing Figures

AUTOMATIC LOCK SLIDER FOR SLIDE FASTENERS

BACKGROUND OF THE INVENTION

1. Field of the Invention

The present invention relates to an automatically locking slider for slide fasteners.

2. Prior Art

U.S. Pat. No. 4,139,928 issued Feb. 20, 1978 discloses an automatically locking slider for slide fasteners in which a locking member comprises a piece of resilient strip, usually made of steel. The locking member has at one end a locking prong and at the other end an anchoring portion. The anchoring portion extends into a clamping groove in a slider's neck and terminates in a laterally recessed end which is retained by a pair of clamping lugs, one on each side wall of the groove. This retaining is accomplished by bending or otherwise deforming the lugs together with part of the side walls around the recessed end. A problem experienced with the prior slider is that a coating of the slider body is apt to easily come off during the bending or deforming operation, making the slider defective from an aesthetic view.

SUMMARY OF THE INVENTION

A locking member includes a piece of resilient strip having a U-shaped base extending around a transverse spindle of a pull tab, a locking prong extending from one end of the base, and an anchor extending from the other end of the base and terminating in a hook-shaped end hooked with a locking-member retaining nose on a slider's neck. The base is normally urged against the spindle of the pull tab by the resilience of the strip. The hook-shaped end of the anchor is normally urged against the nose by the resilience of the strip and is thereby prevented from being unhooked from the nose. Thus the locking member is held in position on a slider body solely by the resilience of the strip, requiring no bending or deformation of any part of the slider body.

Accordingly it is an object of the present invention to provide an automatically locking slider, for slide fasteners, which can be assembled without bending or deformation of any part of a slider body, usually coated or plated before assembling.

Another object of the invention is to provide an automatically locking slider, for slide fasteners, which can be assembled easily and less costly.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
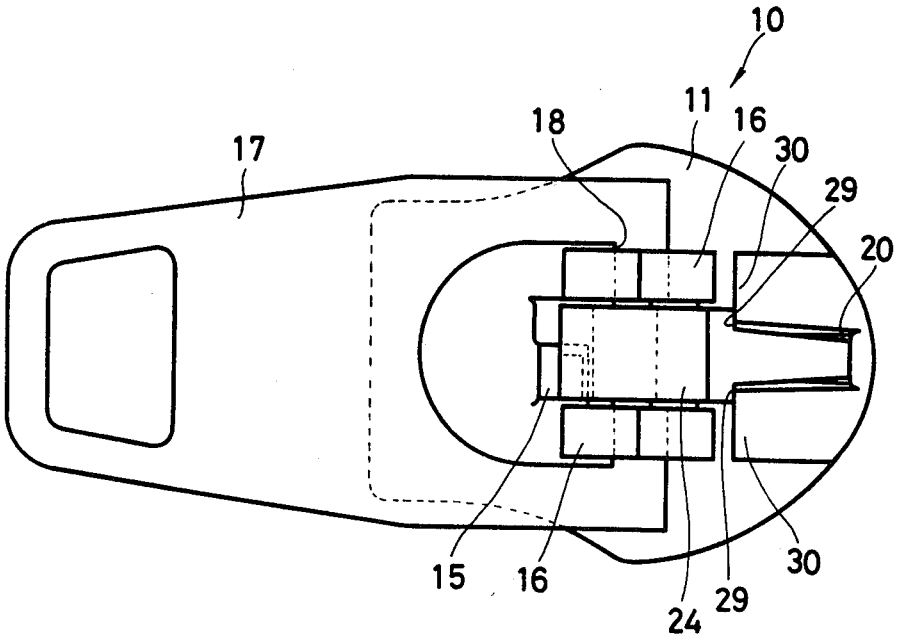
FIG. 1 is a plan view of an automatically locking slider, for slide fasteners, according to the present invention.

The principles of the present invention are particularly useful when embodied in an automatically locking slider for slide fasteners (hereinafter referred to as "slider") such as shown in FIGS. 1 and 5–7, generally indicated by the numeral 10.

The slider 10 comprises a slider body including a pair of flanged first and second (upper and lower) wings 11,12 joined at one end by a neck 13 so as to define a Y-shaped guide channel 14 between the wings 11,12 for the passage of a pair of coupling element rows of a slide fastener (not shown). The first wing 11 has an aperture 15 communicating with the guide channel 14. The first wing 11 further has a pair of laterally spaced lugs 16,16, one on each side of the aperture 15. A pull tab 17 has a transverse spindle 18 journalled by the lugs 16,16 and is hence pivotable on the first wing 11. The transverse spindle 18 has a cam 19 between the lugs 16,16, for a purpose described below.

The neck 13 has a longitudinally (vertically) extending hole 20. The hole 20 has a rectangular cross section and is defined by a pair of opposed front and rear (second and first) walls 21,22 and a pair of opposed unnumbered side walls. A locking-member retaining nose 23 projects from the rear (first) wall 22 and is disposed adjacent to the end of the hole 20 which opens into the second wing 12.

Figure 5:
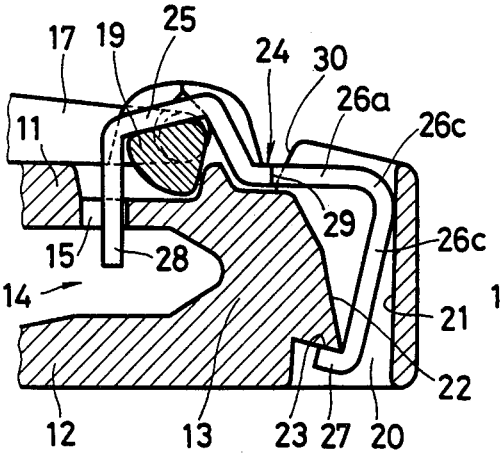
FIG. 5 is a longitudinal cross-sectional view of the slider of FIG. 1, showing the locking member in locking position.

A locking member 24 includes a piece of resilient strip, preferably made of stainless steel, which is bent into a generally "3" shape having a U-shaped base 25, an anchor 26 extending from one end of the base 25 and terminating in a hook-shaped end 27 hooked with the retaining nose 23, and a locking prong 28 extending from the other end of the base 25 for normally projecting into the guide channel 14 through the aperture 15 as shown in FIG. 5.

Figure 6:
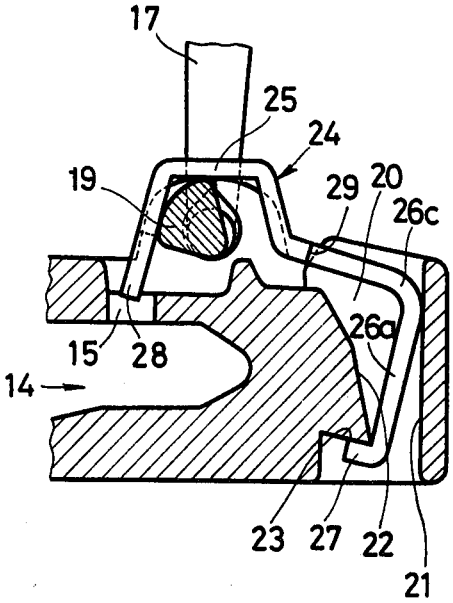
FIGS. 6 and 7 are cross-sectional views similar to FIG. 5, but showing the locking member out of locking position.
Figure 7:
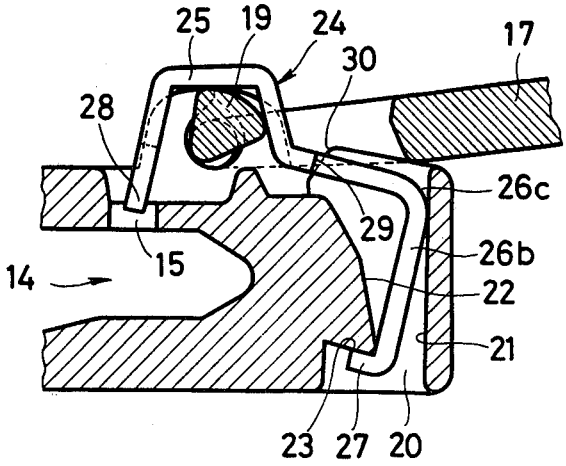

The base 25 extends around the transverse spindle 18 of the pull tab 17 and is normally urged to rest against the cam 19 by the resilience of the strip (24). The cam 19 is angularly movable, in response to the pivotal movement of the pull tab 17, to raise the base 25 away from the first wing 11, causing the locking prong 28 to retract from the guide channel 14 into the aperture 15 as shown in FIGS. 6 and 7.

The anchor 26 of the locking member 24 has a "dogleg" shape including a first section **26*a* extending substantially parallel to the general plane of the first wing 11, and a second section 26*b* extending from a knee 26*c* into the hole 20. The hook-shaped end 27 of the anchor 26 is normally urged against the retaining nose 23 by the resilience of the strip (24) and is thereby prevented from being unhooked from the nose 23**.

The knee **26*c* of the dogleg-shaped anchor 26 touches with the front (second) wall 21 of the hole 20 so that the base 25 of the locking member 24 is angularly movable about the knee 26c as the base 25 is raised away from the first wing 11 by the pull tab 17**.

Figure 2:
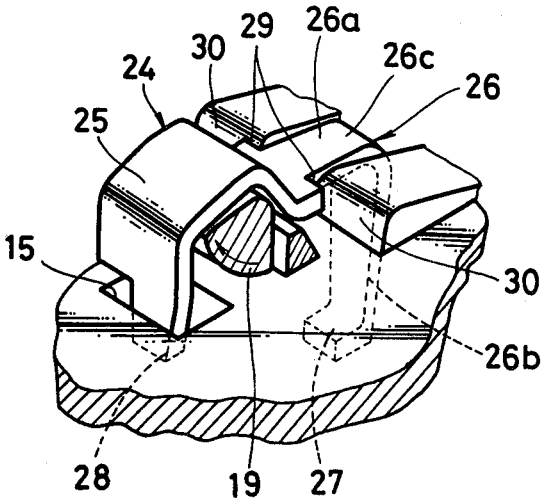
FIG. 2 is a fragmentary perspective view of the slider of FIG. 1, showing a locking member in detail.

Preferably, the locking member 24 has a pair of shoulders 29,29 at the first anchor section 26a adjacent to the base 25, as better shown in FIGS. 1 and 2. The first wing 11 has a pair of laterally spaced, inclined support surfaces 30,30 so that each shoulder 29,29 is slidable on and along one of the support surfaces 30,30 as the locking member 24 is pivotally moved by the pull tab 17. The locking member 24 is thereby prevented from being laterally displaced on the slider body.

The rear (first) wall 22 of the hole 20 has a slope 22a extending from a first-wing-side end of the hole 20 to a tip of the retaining nose 23, for a purpose described below.

Figure 3:
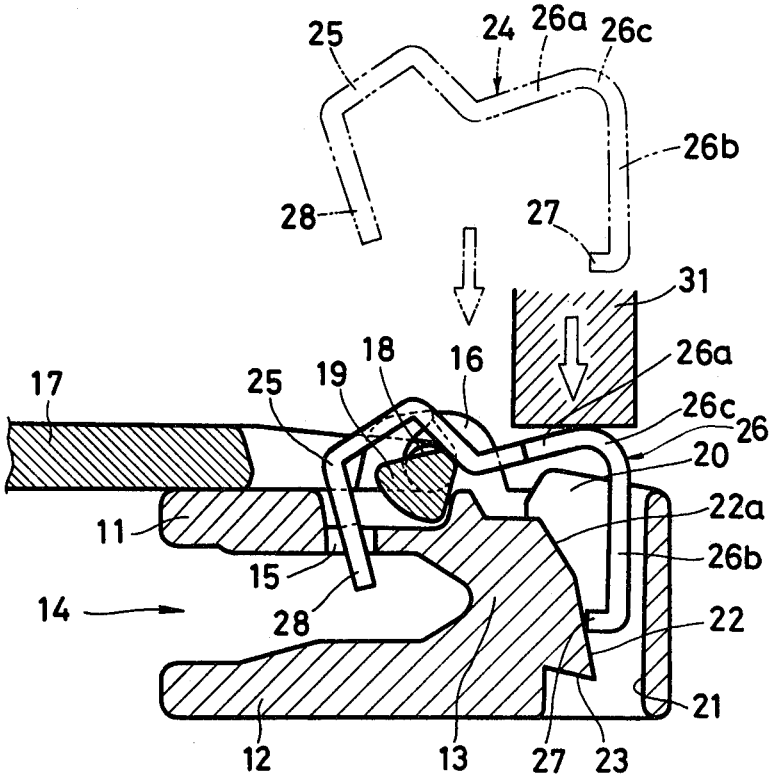
FIGS. 3 and 4 are longitudinal cross-sectional views of the slider of FIG. 1, showing the manner in which the locking member is mounted on a slider body.
Figure 4:
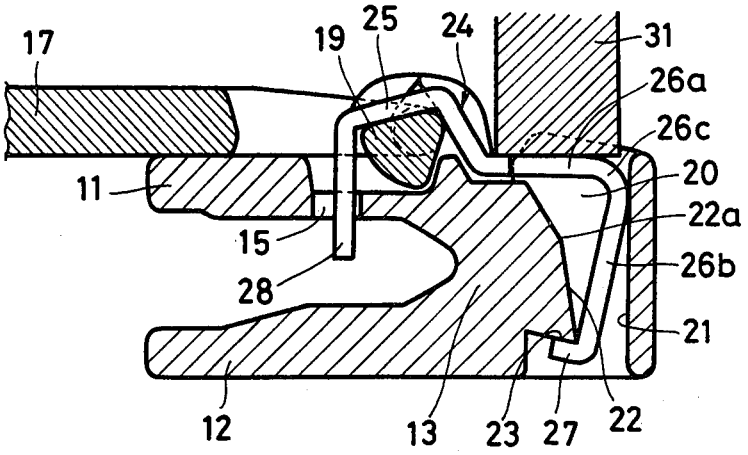

For assembly, the locking member 24 is so formed that its shape is in its free form (FIG. 3) somewhat distorted in relation to the shape of FIG. 4 after having been mounted on the slider body. The locking member 24 is placed on the slider body, as indicated by solid lines in FIG. 3. At that time the second anchor section 26b projects into the hole 20 and terminates short of a tip of the nose 23, touching the slope 22a at the hook-shaped end 27. The U-shaped base 25 rests on the spindle 18 of the pull tab 17 such that the locking prong 28 projects into or through the aperture 15. Then the locking member 24 is pressed at the first anchor section 26a downwardly against the first wing 11 by a punch or press 31, causing the hook-shaped end 27 of the anchor 26 to slide on and along the slope 22a downwardly, during which time the angled anchor 26 is deflected so as to store resilient energy in the locking member 24. As a result the hook-shaped end 27 of the anchor 26 is snapped into hooking engagement with the nose 23. By this resilience the U-shaped base 25 and the hook-shaped end 27 are normally urged against the cam 19 and the nose 23, respectively, preventing the locking member 24 from being removed from the slider body.

In operation, as the pull tab 17 lies on the first wing 11 over the rear end as shown in FIG. 5, the locking member 24 is in locking position in which the locking prong 28 projects through the aperture 15 into the guide channel 14 to lockingly engage a pair of coupling element rows of a slide fastener (not shown). At that time the base 25 of the locking member 24 is in lowered position.

When the pull tab 17 is pivotally moved from the position of FIG. 5 to the position of FIG. 6, i.e. upright position, the base 25 of the locking member 24 is raised by the cam 19 against the bias of the strip (24), causing the locking prong 28 to be retracted from the guide channel 14 into the aperture 15 to release the pair of fastener coupling element rows (not shown). Thus the locking member 24 is out of locking position.

With continued pivotal movement of the pull tab 17, from the position of FIG. 6 to the position of FIG. 7, in which the pull tab 17 lies on the first wing 11 over the front end, no substantial movement of the locking member 24 is effected; that is, the locking member 24 is maintained out of locking position.

The shoulders 29,29 of the locking member 24 are guided by the support surfaces 30,30, respectively, while the locking member 24 is pivotally moved by the pull tab 17. Accordingly the locking member 24 is prevented from being laterally displaced on the slider body.

In this embodiment since the knee 26c of the dogleg-shaped anchor 26 touches with the front (second) wall 21 of the hole 20, the base 25 of the locking member 24 is angularly movable about the knee 26c, not about the hook-shaped end 27.

Figure 8:
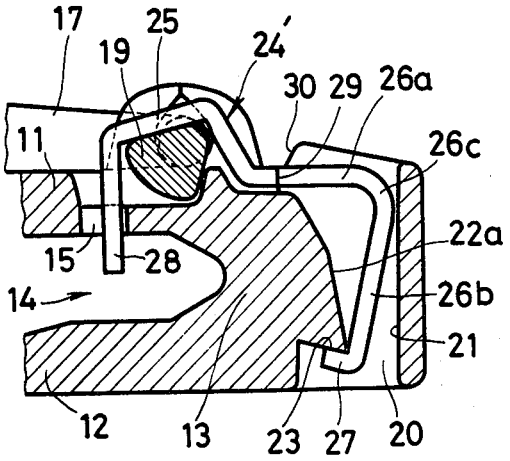
FIG. 8 is a longitudinal cross-sectional view of a slider according to another embodiment, showing a modified locking member in locking position.

According to another embodiment of FIG. 8, a modified locking member 24' is so formed that, when mounted on the slider body, the knee 26c of the dogleg-shaped anchor 26 is spaced from the front (second) wall 21 of the hole 20. The locking member 24' is mounted on the slider body in the same manner as the previous embodiment.

Figure 9:
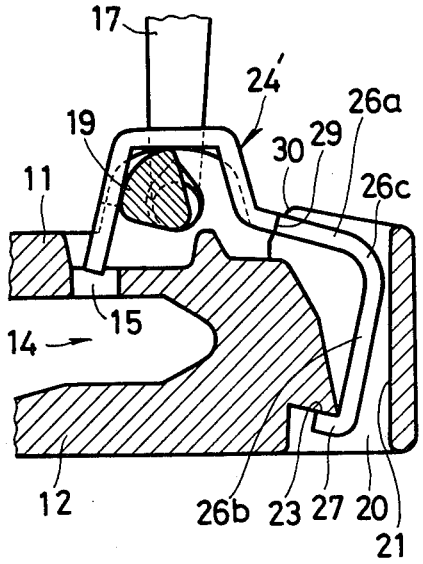
FIG. 9 is a view similar to FIG. 8, but showing the modified locking member out of locking position.

As shown in FIG. 8, when the locking member 24' is in locking position, the knee 26c of the anchor 26 is spaced from the front wall 21. When the locking member 24' is pivotally moved from the position of FIG. 8 to the position of FIG. 9 in which the locking member 24' is out of locking position, the pivoting takes place substantially about said hook-shaped end 27, and the knee 26c is still spaced from the front wall 21.

In any of the preceding embodiments, the locking member 24,24' can be mounted on the slider body without bending or deforming of any part of the slider body.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An automatically locking slider for a slide fastener having a pair of coupling element rows, said slider comprising:

(a) a slider body including a pair of first and second wings joined at one end by a neck, there being defined a Y-shaped guide channel between said wings for the passage of the pair of coupling element rows of the slider fastener, said first wing having an aperture communicating with said guide channel, said neck having a projecting locking-member retaining nose adjacent to said second wing;

(b) a pair of laterally spaced lugs on said first wing, one on each side of said aperture;

(c) a pull tab pivotably connected to said lugs and having a transverse spindle journalled thereby in a fixed axis; and (d) a locking member pivotably supported on said slider body and including a resilient strip having (1) a U-shaped base extending around said transverse spindle and normally urged thereagainst by the resilience of said strip, said base being angularly movable away from said first wing in response to the pivotal movement of said pull tab against the bias of said strip, (2) an anchor extending from one end of said base and terminating in a hook-shaped end hooked with said retaining nose, said hook-shaped end being urged against said nose by the resilience of said strip and thereby prevented from being unhooked from said nose, and (3) a locking prong extending from the other end of said base for normally projecting into said guide channel through said aperture to lockingly engage with the pair of coupling element rows, said locking prong being retractable, from said guide channel into said aperture, in response to the angular movement of said base away from said first wing.

2. A slider according to claim 1, said anchor of said locking member having a pair of shoulders adjacent to said one end of said base, said first wing having a pair of laterally spaced, inclined support surfaces slidably supporting said pair of shoulders, respectively, each said shoulder being slidable along one of said support surfaces in response to the angular movement of said base, said locking member being thereby prevented from being laterally displaced on said slider body.

3. A slider according to claim 1, said neck having a longitudinally extending hole having a pair of opposed first and second walls, said retaining nose projecting from said first wall.

4. A slider according to claim 3, said anchor of said locking member having a dogleg shape of less than 90° including a first section extending parallel to the general plane of said first wing into said hole.

5. A slider according to claim 4, a knee of such a dogleg shape touching said second wall of said hole, said base of said locking member being thereby pivotally movable substantially about said knee.

6. A slider according to claim 3, said first wall having a slope extending from a first-wing-side end of said hole to said retaining nose.

7. A slider according to claim 4, a knee of such a dogleg shape being spaced from said second wall of said hole, said base of said locking member being thereby pivotally movable substantially about said hook-shaped end.

8. A slider according to claim 1, said transverse spindle having an arcuate cam intermediate its ends for raising said base of said locking member away from said first wing in response to the pivotal movement of said pull tab.

* * * * *